US005294923A

United States Patent [19]

Juergens et al.

[11] Patent Number: 5,294,923

[45] Date of Patent: Mar. 15, 1994

[54] METHOD AND APPARATUS FOR RELAYING DOWNHOLE DATA TO THE SURFACE

[75] Inventors: Rainer Juergens, Celle, Fed. Rep. of Germany; Leslie T. Shale, Houston; Frank C. Forest, Richmond, both of Tex.

[73] Assignee: Baker Hughes Incorporated, Houston, Tex.

[21] Appl. No.: 828,402

[22] Filed: Jan. 31, 1992

[51] Int. Cl.[5] ..... G01V 1/00

[52] U.S. Cl. ..... 340/854.9; 340/855.1; 340/853.4; 340/853.6; 175/40; 175/45

[58] Field of Search ..... 340/853.1, 853.3, 853.4, 340/853.6, 853.8, 854.9, 855.1, 855.2, 856.1; 175/40, 45, 61

[56] References Cited

U.S. PATENT DOCUMENTS

| | | | |
|---|---|---|---|
| 3,825,078 | 7/1974 | Heilhecker et al. | 175/57 |
| 3,957,188 | 5/1976 | Barry et al. | 166/315 |
| 4,181,184 | 1/1980 | Scherbatskoy | 175/65 |
| 5,105,878 | 4/1992 | Forest et al. | 175/40 |
| 5,107,939 | 4/1992 | Lenhart et al. | 175/61 |

FOREIGN PATENT DOCUMENTS 2210087 1/1989 United Kingdom .

OTHER PUBLICATIONS

Shale, Leslie T., "Development of Air Drilling Motor Holds Promise For Specialized Directional Drilling Applications", SPE Paper No. 22564, Oct. 1991, pp. 275–286.

*Primary Examiner*—J. Woodrow Eldred

*Attorney, Agent, or Firm*—Trask, Britt & Rossa

[57] ABSTRACT

An apparatus and method for the transmission of information between downhole and surface locations through a drillstring. The apparatus includes a wireline extending from instrumentation at the downhole location to a clamp-off sub in the drillstring where it is connected to the lower end of a cable spooled on a cable cartridge above the clamp-off sub in the drillstring. The cable cartridge is moved upwardly through successive pipe joints added to the drillstring as drilling progresses, to permit rotation of the drillstring and use of blowout preventors without retrieving the wireline or cable. Cartridge cable is releasably connected at its upper end to a wireline extending through a pack-off to a slip ring assembly at the surface, for transmitting data from downhole instrumentation to surface equipment. Multiple cable cartridges may be sequentially added in series if drilling proceeds beyond the length of cable in a single cartridge.

35 Claims, 5 Drawing Sheets

METHOD AND APPARATUS FOR RELAYING DOWNHOLE DATA TO THE SURFACE

BACKGROUND OF THE INVENTION

1. Field of the Invention

The present invention relates generally to the transmission of information between a downhole location and a surface location, and more specifically to an apparatus and method for the transmission of information between downhole and surface locations during the conduct of a subterranean drilling operation using air or gas as the energy source for a downhole drilling motor.

2. State of the Art

Drilling for oil and gas with downhole motors employing dry air, mist, or foams (all referred to hereinafter generically as "air") as a drilling fluid has been contemplated and practiced with some limited success for a number of years. Use of air as the drilling fluid, because of its low density, can result in faster penetration rates. Moreover, air drilling is less damaging to the producing formation than oil- or water-based drilling fluids. However, the reduced hydrostatic head of the air drilling fluid cannot effectively control formation pressures nor support borehole wall against collapse, and therefore air drilling is substantially limited to competent formations and requires religious use of blow-out preventors ("BOP's").

The foregoing limitations notwithstanding, air drilling has many applications, and improved motor technology has popularized its use in recent years, particularly in navigational drilling operations where a bottomhole assembly including a drilling motor may be steered to drill either a curved path or straight ahead. When drilling a nonlinear path, the bottomhole assembly is oriented in a particular direction, and drilling proceeds under power of the motor alone. For straight ahead drilling, the drillstring is rotated to negate the drill bit tilt angle or offset from the longitudinal axis of the bottomhole assembly. One suitable and recently developed bottom hole assembly for air drilling is the Navi-Drill Mach 1/AD, employed by Eastman Christensen Company of Houston, Tex., which assembly includes a positive displacement Moineau-type air motor and an adjustable bent sub between the motor and the drill bit, the bent sub providing the desired bit tilt angle for nonlinear drilling. An additional bent sub may be placed above the motor to enhance the assembly's kick off abilities, but such an arrangement precludes drillstring rotation and straight ahead drilling.

When drilling directionally or navigationally it is, of course, imperative to track the azimuth and inclination of the actual borehole against the intended well plan. Many survey, steering and measurement-while-drilling ("MWD") devices and techniques have been developed and employed over the years, but experience has confirmed many deficiencies and limitations of the prior art apparatus and methods when employed in an air drilling environment.

Conventional survey instrumentation, and particularly high accuracy gyroscopic instrumentation, is somewhat delicate for use in air drilling, as the drilling fluid does not provide dampening of deleterious vibration and resonance effects. Moreover, when conducting a navigational drilling operation, drilling torque may drastically change the toolface orientation and thus the borehole path over a short drilling interval, and survey techniques only confirm such changes after the fact.

Conventional MWD systems employ pressure pulses in the drilling fluid to transmit information from the downhole probe to the surface. As air is highly compressible, it cannot be pulsed effectively, and so conventional mud-pulse MWD technology is inoperative in air-drilled boreholes. Electromagnetic MWD ("EM MWD") systems, which employ the drillstring as the transmission media for electromagnetic waves, have been employed in air-drilled holes with mixed results. Rougher drilling conditions in air-drilled holes commonly cause tool failure, and EM MWD use can be severely hampered by formation resistivity. Finally, use of EM MWD requires a conductive drilling fluid, and therefore cannot be used for dry air drilling.

A steering tool offers significant advantages while navigationally drilling, as it provides continual surface readout of survey data while drilling, including the highly important toolface readout, solving the problem of reactive torque effects causing toolface orientation change. Steering tools also offer almost instantaneous information, unlike MWD tools, which do not continuously transmit data between the downhole location and the surface. Wireline-controlled steering systems have been employed in directional drilling, such systems including a side-entry sub and split kelly for the wireline to maintain contact with the probe. With a side-entry sub, the wireline is on the outside of the drillstring, and therefore subject to kinking, wear and breakage. If the probe signal is lost, the drillstring must be pulled out of the hole to the location of the side-entry sub, and the probe retrieved. Moreover, these systems preclude rotation of the drillstring due to the exterior location of the wireline. If a swivel assembly is used instead of a side-entry sub, the steering tool must be round-tripped out of the hole whenever a drill pipe joint connection is made, although in this case the drillstring may be rotated for straight ahead drilling. Finally, use of a wireline exterior to the drillstring precludes full closure of the BOP's unless the wireline is seuered.

Wet-connect systems have been developed wherein a steering tool probe having a wireline leading to a connection on the upper end thereof is run into the drillstring at the kickoff point, the upper end clamped off at the connection, and an upper wireline section with a mating connection on the lower end thereof is run into the drillstring to electrically connect the probe for directional drilling. While effective, such systems cause lost rig time due to the necessity for wireline retrieval prior to drillstring rotation.

Horizontal air-drilled wells provide additional problems as, at well inclinations exceeding 70 degrees from the vertical, a steering or survey tool will no longer fall down the drillstring, nor will air passing by the tool generate enough drag to carry it downhole. Currently, two methods are used to address this problem. In the first, the drillstring is pulled from the hole until the bit is at 70 degrees of inclination, a side-entry sub installed and a survey or steering tool run on electric line to a latching assembly above the drill bit, and the drillstring tripped back to bottom with the wireline above the side entry sub on the outside of the drillstring. A survey is then taken, the drillstring tripped back out to the side-entry sub, the survey tool and side-entry sub removed, and the drillstring run back to bottom to continue drilling. Obviously, a great deal of rig time is wasted with this method, and the driller learns of deviations from the well plan after the fact. The second method reduces time somewhat, by running a survey tool on a slickline with a releasing overshot when the drillstring has been pulled to the 70 degree inclination point. Upon reaching the monel drill collars, a monel sensor activates the releasing overshot, disconnecting the survey tool from the slick line, which is then removed from the hole. The drillstring is tripped back to the bottom to take the survey, subsequent to which the drillstring is pulled to 70 degrees, and the survey tool retrieved with a standard overshot run in on slickline. It will be appreciated that significant rig time is still involved with this method.

SUMMARY OF THE INVENTION

In contrast to the prior art apparatus and methods, the apparatus and method of the present invention allows a bottom hole assembly employing an air-powered drilling motor to be employed as a steerable drilling system combining directional and straight hole drilling capabilities to provide precise directional control.

The present invention provides a realtime survey system having the capability of withstanding the air harmonics and vibration attendant to air drilling operations. The major system components include a steering tool incorporated in a probe or latch down assembly which is releasably securable to a latching module located within the non-magnetic drill collars of a drillstring above the downhole motor, a first wireline extending upwardly to carry a signal from the steering tool to a clamp-off sub secured in the drillstring whereat the wireline is electrically connected to the free, lower end of a cable spooled on a cable cartridge secured in the drillstring, from which point a second wireline extends upwardly from the upper end of the cartridge cable to a pressure-tight rotating slip ring assembly at the surface. A surface cable transmits the signal from the slip ring assembly to a surface processing unit which provides data to a driller's remote display and a computer.

For highly deviated and horizontal boreholes, the steering tool may be a tri-axial steering tool of the type such as is commercially available from Eastman Christensen Company or Sharewell, Inc., both of Houston, Tex., to provide inclination, azimuth and toolface orientation. Such tools are shielded against pressure and temperature effects of downhole use to the degree required for the well being drilled.

The clamp-off sub provides mechanical support for the connection of the first wireline from the steering tool to the cable from the cartridge, and is secured between the pin and box of a drill pipe connection after the probe or latch down assembly is run and latched into the drillstring at the kick off point of the borehole, where the inclined portion thereof is commenced. The cartridge is initially secured at the pipe joint next above the clamp-off sub, and the second, upper wireline connected to the cartridge cable extends to the slip ring assembly above the kelly for transmission of data during drilling. After the kelly is made up and first pipe joint is drilled down, the wireline cartridge is pulled upwardly through the next joint after connection to the top of the drillstring, reconnected electrically to the slip ring assembly, the kelly made up and drilling recommenced. If a single cartridge does not provide sufficient cable, additional cartridges may be added sequentially as drilling progresses.

Since no wireline or other cable is exterior to the drillstring, rotation thereof for straight ahead drilling is possible, the use of the cartridge eliminates tripping of the drillstring when pipe joints are added, and operations of the BOP's is unaffected.

DETAILED DESCRIPTION OF THE PREFERRED EMBODIMENT

Figure 1:
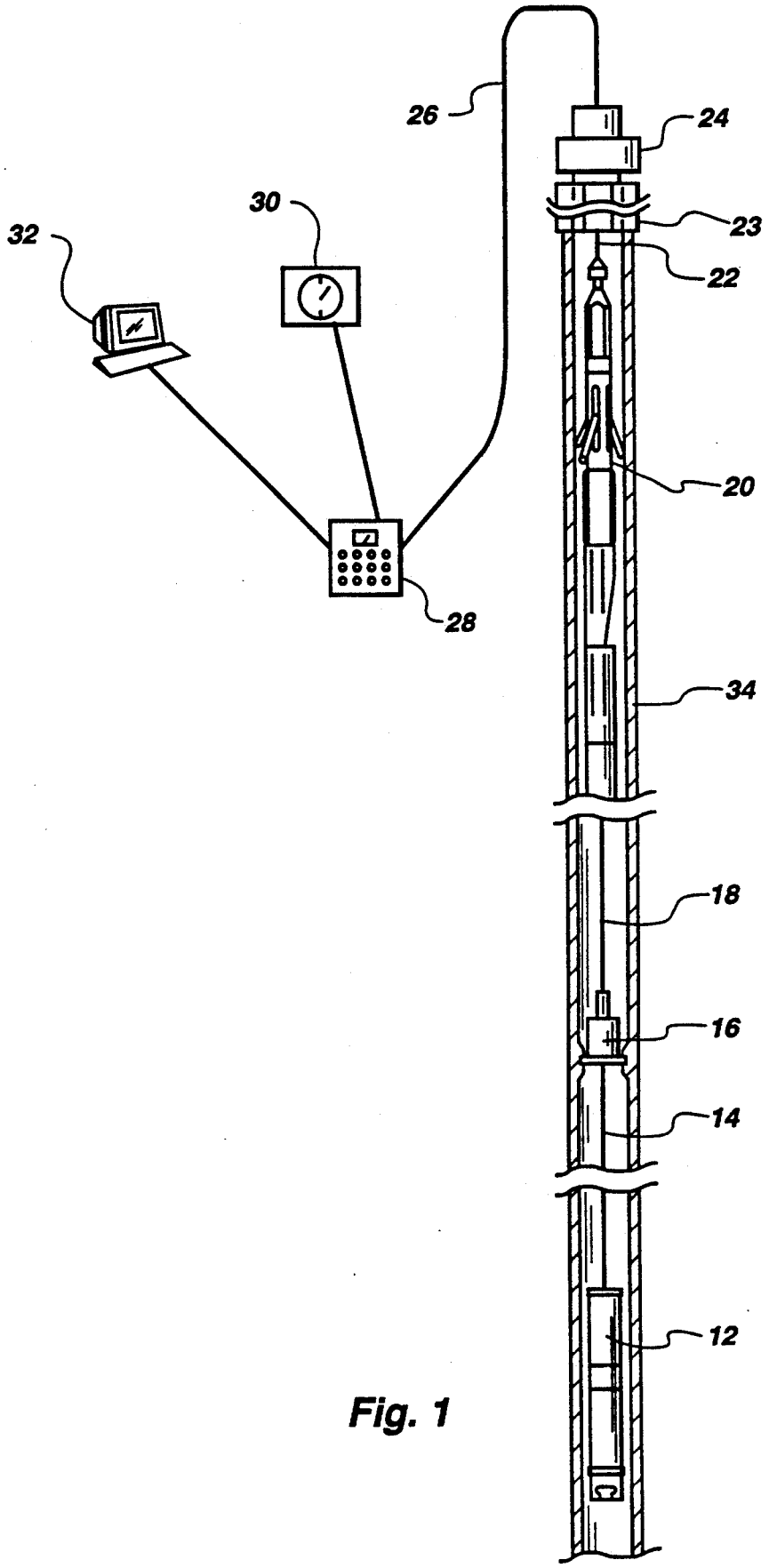
FIG. 1 of the drawings is a schematic representation of the major components of the data transmission apparatus of the present invention.

FIG. 1 depicts the major elements of the data transmission apparatus 10 of the present invention. From the bottom of the drawing, steering tool probe 12 is assembled into a probe or latch down assembly 40 (see FIG. 2) by which it is mechanically and electrically connected to a lower single conductor electric wireline 14, which extends to a clamp-off sub 16 for mechanically and electrically connecting wireline 14 to cable 18 extending from the lower end of cable cartridge 20. The cable 18 of cable cartridge 20 is mechanically and electrically connected at the upper end of cartridge 20 to an upper single conductor electric wireline 22, the latter extending upwardly to a rotating slip ring assembly 24 located above the kelly 23, slip ring assembly 24 providing a pressure-proof rotatable electrical connection to surface output cable 26 extending to processing unit 28. With such an arrangement, information such as inclination, azimuth and toolface from steering tool probe 12 may be transmitted uphole to processing unit 28, the output of which is graphically depicted on driller's remote display 30 and/or on the monitor of computer 32, whereat the processed information from steering tool probe 12 may also be stored. Elements 12 through 22 of apparatus 10 of the present invention are disposed within a string of drill pipe (shown schematically at 34) during the drilling operation, the drillstring 34 also including below steering tool probe 12 a steerable bottomhole assembly (not shown) of the type previously described. It is also contemplated that the information transmission apparatus of the present invention may be employed to transmit commands from the surface to the steering tool, which in some future applications may be employed to actively change the path of the borehole.

Figure 2:
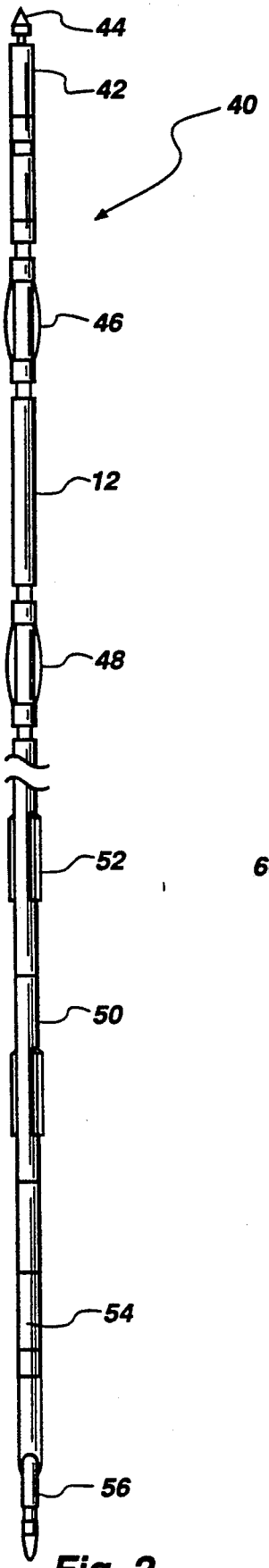
FIG. 2 is an elevation of a suitable steering tool probe assembly for use with the present invention.

FIG. 2 depicts the components of a probe or latch down assembly 40 which includes steering tool probe 12. At the top of probe or latch down assembly 40 is cable head 42, by which probe assembly 40 is lowered into the drillstring on wireline 14, which is secured to a rope socket in cable head 42. Cable head also 42 includes a fishing head 44 at the top thereof, for retrieval of probe or latch down assembly 40 via an overshot should wireline 14 part. Below cable head 42, probe 12 (in a ruggedized, pressure-proof housing) is secured to and bracketed by upper and lower centralizers 46 and 48, respectively, below which are secured one or more spacers bars 50 having centralizing fins 52 thereon, the number of spacer bars 50 being determined by calculation of the required magnetic isolation from the bottom hole assembly below probe 12. Shock absorber 54 is located below the lowermost spacer bar 50 to provide longitudinal and preferably radial shock isolation for probe 12 during landing of probe or latch down assembly 40 in the non-magnetic drill collars. Stinger 56 at the bottom of probe or latch down assembly 40 positively latches into a latch down module at the bottom of the string of non-magnetic drill collars at the lower end of drillstring 34 to secure probe or latch down assembly 40 thereinto, and also to properly rotationally orient probe 12 via exterior profile 58 with respect to the drill bit for proper toolface readings. The housing of steering tool probe 12, as noted previously, comprises a pressure barrel, and may include flexible rubber fins on the exterior thereof for centralization of the probe within the non-magnetic drill collars. The use of rubber fins permits the probe to pass through a 2⅛" diameter drill collar bore followed by re-expansion of the fins to centralize the probe in a 2 13/16" non-magnetic drill collar bore below the constriction. However, it has been difficult to achieve a good compromise between fin flexibility for passage through the constriction and rigidity required for centralization. Therefore, it has also been proposed to utilize radially inwardly extending fins on the non-magnetic drill collar bore for support and centralization of the probe. Such an arrangement has been disclosed in U.S. patent application Ser. No. 750,615, filed Aug. 27, 1991, assigned to the assignee of the present invention, and incorporated for all purposes herein by this reference. Use of internal drill collar fins obviously eliminates the problem of probe passage through the constricted drill collar bores.

Figure 3A:
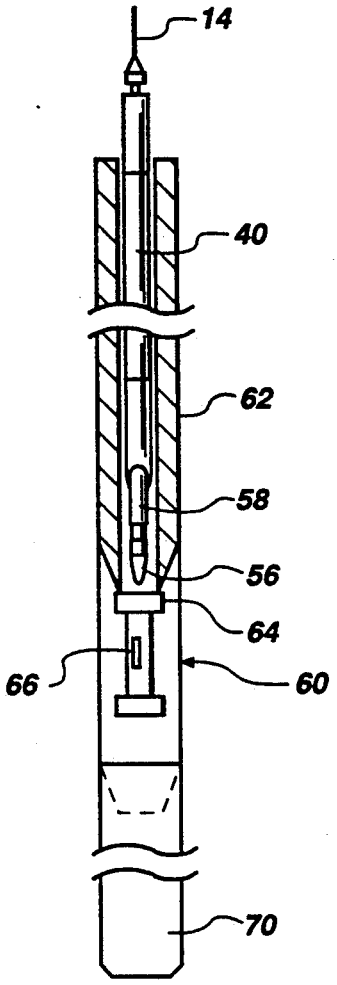
FIGS. 3A and 3B are schematic elevations showing the latching of the steering tool probe assembly into the non-magnetic drill collars above the downhole motor.
Figure 3B:
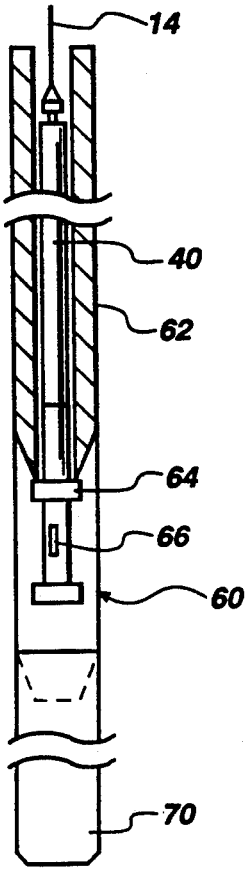

FIGS. 3A and 3B depict, respectively, the lowering of probe or latch down assembly 40 into latch down module 60 at the bottom of a string of non-magnetic drill collars 62 above steerable bottom hole assembly 70. The latch down module 60 includes a latch down sleeve 64 which engages stinger 56 to retain probe or latch down assembly 40 against upward motion, and which, via key 66, interacts with exterior profile 58 to rotate probe or latch down assembly 40 as previously mentioned. The stinger 56 and latch down module 60 may be of any design previously known in the art, but it has been discovered that the retention capability of the latter should be increased for use in air drilling, in order to prevent inadvertent upward release of probe or latch down assembly 40 due to pressure differentials when air pressure is bled off from the drillstring, such as when new pipe joints are being added.

Probe or latch down assembly 40 is lowered into drillstring 34 when a predetermined depth has been reached and the wellbore is to depart from the vertical. Wireline 14 is pulled taut after engagement of stinger 56 with latch down sleeve 64. Clamp-off sub 16 is then placed around wireline 14 in the bore back of the uppermost joint of drill pipe at the surface, clamped about wireline 14, and wireline 14 is then severed above clamp-off sub 16. Clamp-off sub 16 preferably comprises two mating sections, each having a vertical recess therein to define a passage for wireline 14, the passage being of smaller diameter than the wireline 14 so that the wireline 14 is clamped and held therebetween when the two sections of the clamp-off sub 16 are transversely bolted together.

Figure 4:
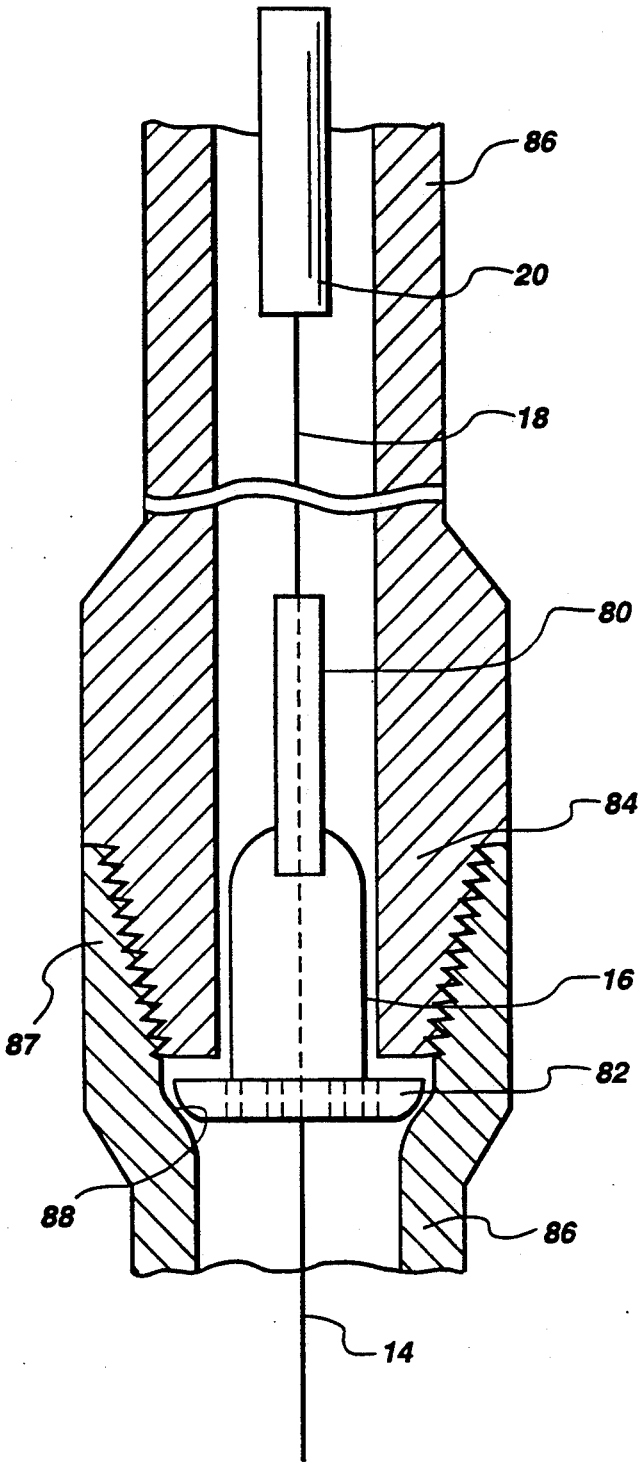
FIG. 4 is a schematic of a clamp-off sub for use with the present invention.

FIG. 4 depicts clamp-off sub 16, whereat wireline 14 terminates and is electrically joined to cable 18 extending from a cable cartridge 20. As noted above, clamp-off sub 16 employs technology well known in the art for wireline cable heads to mechanically grip and support the upper end of wireline 14. The lower end of cable 18 is also mechanically locked in transition section 80 of sub 16, so that the electrical connection of the two, made within transition section 80, remains mechanically unstressed. As drilling progresses, collar 82 of clamp-off sub 16 rests between a pin 84 of one tool joint 86 and the box back 88 of the adjacent joint 86, so as to prevent movement of the clamp-off sub 16 within the drillstring. Collar 82 includes apertures therethrough so as to permit passage past clamp-off sub 16 of air to drive the drillstring motor of the bottom hole assembly. Those components of data transmission apparatus 10 from clamp-off sub 16 and below remain in position until the wellbore reaches its end point, unless a bit, motor or other lower drillstring component is changed.

Figure 5:
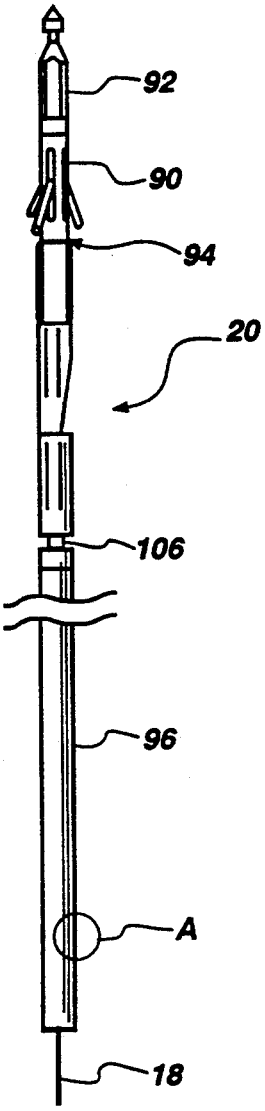
FIG. 5 is an elevation of the wireline cartridge assembly employed in the present invention.
Figure 5A:
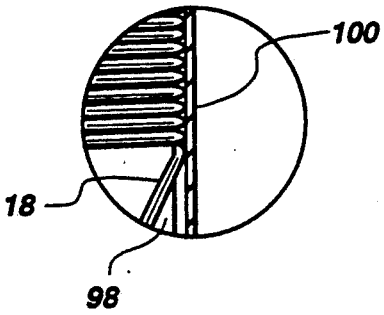
FIG. 5A is an enlarged partial sectional elevation of the cartridge body of the wireline cartridge of FIG. 5.

FIG. 5 illustrates cable cartridge 20 including landing assembly 90 secured to the top of cartridge head 94, and fishing head 92 secured to the top of landing assembly 90. Cartridge head 94 has cable spool 96 secured to the bottom thereof, a portion of which is shown enlarged in partial section in FIG. 5A. Cable 18 is wrapped transversely about inner mandrel 98 of cable spool 96 in a single layer, and protected by heat shrink tubing 100 which is applied to mandrel 98 after cable 18 is wrapped thereabout. The upper end of cable 18 is secured to cartridge head 94, terminating at a connector such as a keystone seat, by which the cable 18 may be positively mechanically secured and electrically connected to an upper wireline 22 leading to slip-ring assembly 24 or to the lower end of another cable from another cable cartridge 20 in the drillstring. The design of cable cartridge 20 is based upon a cartridge design developed by Sharewell, Inc., of Houston, Tex. for use in pipelines, utility conduits, and river crossings, and the principle of operation remains the same. If cable is pulled from the bottom of mandrel 98, friction will stop the payout of cable after three to four feet, at most. However, if cable cartridge 20 is moved upwardly, cable will pay out for the upward distance the cartridge is moved. A patent application was filed on the Sharewell, Inc. cartridge design on Feb. 9, 1990 and assigned Ser. No. 477,720 and has now issued as U.S. Pat. No. 5,105,878. The original Sharewell cartridge had concentric inner and outer mandrels, with a plastic or elastomeric sleeve surrounding the cable inside the outer mandrel. Furthermore, the original Sharewell design employed spring-loaded dogs to lock the cartridge against downward or backward movement in the pipe or conduit, requiring the size of the dogs to be changed for each pipe or conduit I.D.

The cable cartridge design of the present invention employs a landing assembly 90 removably secured to the top of cartridge head 94, landing assembly 90 including three pivotally mounted, coil spring-loaded, downwardly and radially outwardly extending legs 102 to accommodate different drill pipe bore diameters. The spring loading of the portion of the legs 102 inside the landing assembly 90 can be adjusted upwardly for use of the landing assembly in a large bore drill pipe, or downwardly for use in a small bore drill pipe. Additionally, a landing seat plate or hold down ring 104, is employed with cartridge head 94 when landing assembly 90 is not in use. Finally, the cartridge design employed in the present invention is of much smaller diameter and greater length than the Sharewell design, to accommodate small diameter drill pipe while providing an acceptable length of cable, approximately 380 feet, or ten pipe joints.

Figure 6A:
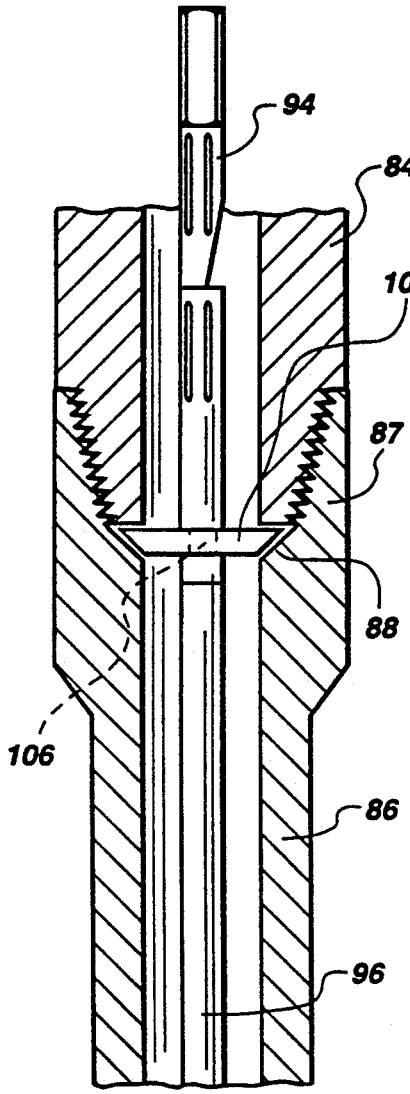
FIGS. 6A, 6B and 6C are, respectively, schematic elevations showing a wireline cartridge locked in a connection between two pipe joints, a wireline cartridge with a landing assembly removably positioned within a pipe joint connection, and a wireline cartridge during upward withdrawal though a joint of drill pipe.
Figure 6B:
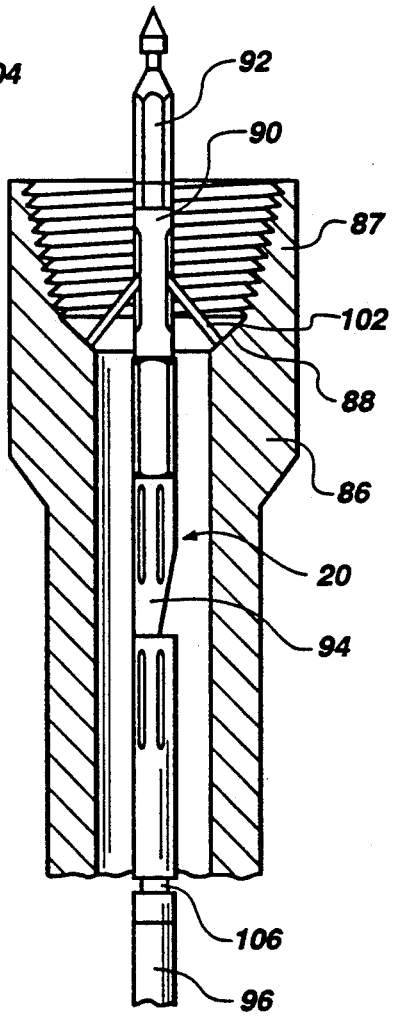
Figure 6C:
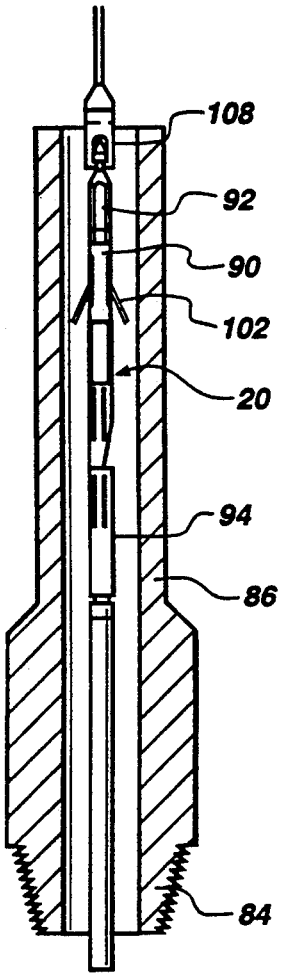

With reference to FIGS. 6A, 6B and 6C, the use of cartridges 20 will be hereinafter discussed. After the lower end of a cable 18 is secured to clamp-off sub 16, the next pipe joint 86 to be connected to the top of drillstring 34 is picked up with the elevators, an overshot is dropped through the pipe joint, locked onto fishing head 92 and cable cartridge 20 including cartridge head 94 and landing assembly 90 is pulled upwardly into the next pipe joint 86 (See FIG. 6C). The pipe joint 86, with cable cartridge 20 in its bore, is connected to the pipe string and the string is lowered until the box of the uppermost pipe joint 86 is on the surface. The overshot is then retrieved, pulling the cable cartridge 20 through the pipe bore to the box connection 88 on surface. In that position, landing seat plate or hold down ring 104, preferably having a beveled or chamfered periphery, as shown, and having a U-shaped mouth or aperture therein extending between the center and one side thereof is inserted about neck 106 of cartridge head 94 and cable cartridge 20 is lowered into the bore back 88 of box 87 (see FIG. 6A). Landing assembly 90 with attached fishing head 92 is then removed from the top thereof. The kelly 23 is picked up, positioned above the drill pipe box 87 on surface and upper wireline 22 extending from slip ring sub 24 through the kelly 23 is connected to the upper end of cable 18 at the cartridge head 94. The kelly 23 is made up and drilling commences. Cartridge 20 is supported in the box back 88 of the pipe joint 86, and the pin of the kelly 23 prevents upward movement of cartridge 20. The foregoing procedure is employed every time a cable cartridge is added to the drillstring. Drilling may progress either with or without drillstring rotation, with the steering tool latched into the non-magnetic drill collars being employed for guidance in the latter instance.

The drillstring 86 is drilled down to the top of the kelly 23, the slips are set and the drillstring is pulled up so that the uppermost pipe joint box is on surface, the kelly 23 broken from the drillstring, upper wireline 22 disconnected from cartridge head 94, the landing assembly 90 resecured to cartridge head 94, and hold down ring 104 removed. Cable cartridge 20 is again lowered into the top pipe joint 86 until the landing assembly legs 102 seat into the bore back 88, landing assembly 90 maintaining cable cartridge 20 in position (see FIG. 6B). The next joint of drill pipe is picked up by the kelly 23 from the mouse hole, lowered onto the box connection containing the cable cartridge 20, and made up. The slips are removed, and the drillstring lowered until the highest drill pipe box (at the new top pipe joint) is on surface. The slips are again set, the kelly 23 broken from the drill pipe, and moved to one side. An overshot 108 is run into the top joint 86 to engage fishing head 92 on top of landing assembly 90, and cartridge 20 pulled (see FIG. 6C) above the top of the top pipe joint 86, where the hold down ring 104 is reinstalled and cable cartridge 20 lowered into the box bore back 88. The landing assembly 90 is removed, the kelly 23 brought across and positioned above the drill pipe box on surface, wireline 22 retrieved and reconnected to cable head 94. The kelly is made up and drilling again proceeds. This process continues joint by joint until the cable 18 is fully payed out from a cartridge, whereupon the lower end of a cable from another cable cartridge 20 is connected to the cable at the cartridge head 94 according to the procedure described above with respect to the first cable cartridge 20.

Figure 7:
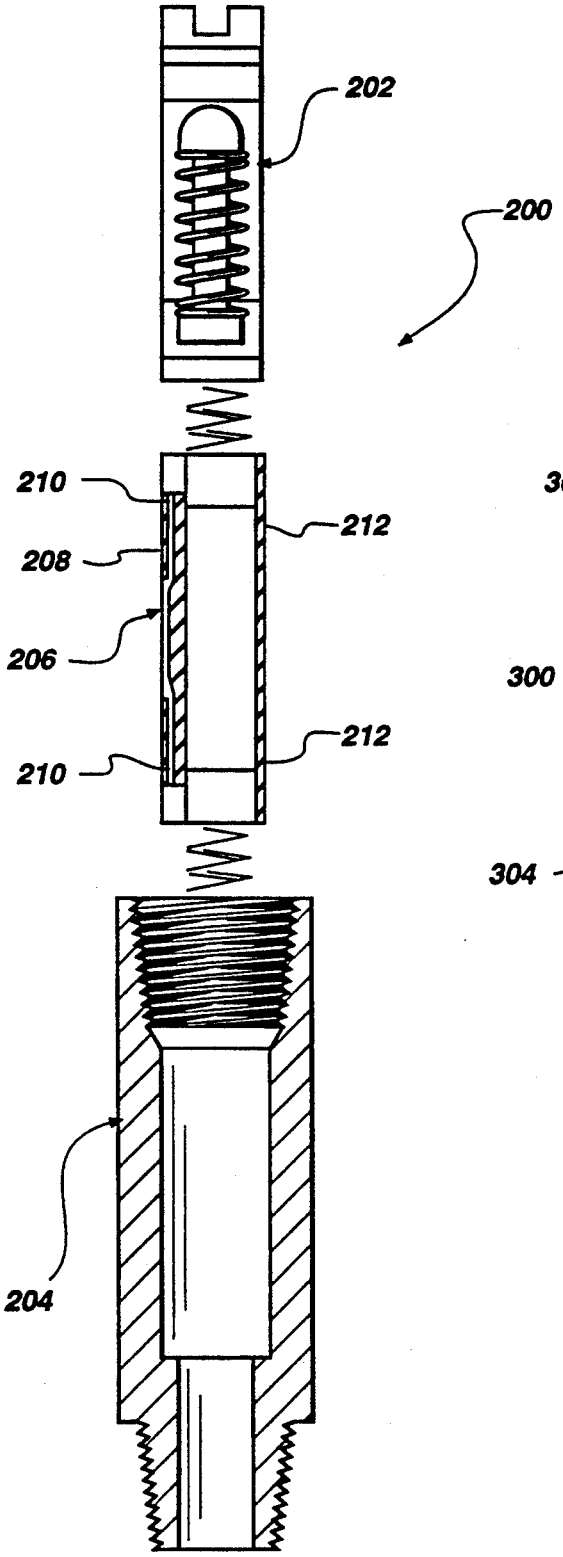
FIG. 7 is an exploded schematic view of the components of a float valve bypass assembly of the present invention.

FIG. 7 depicts a float valve bypass assembly 200 including a float valve 202 of standard design, a float valve sub 204, and a float valve bypass sleeve 206 which accommodates the passage of cartridge cable 18 in channel 208 past float valve 202 installed therein while preventing pressure bypass thereof. Several float valves will be employed in the drillstring, commencing with a hammer float at the drill bit, a standard float valve above the motor, and several others in the string above the clamp-off sub. The float valve bypass assembly 200 of the present invention accommodates the use of the cable cartridges 20, and permits bleedoff of only the top portion of the drillstring between the uppermost float valve 202 and the surface, reducing the time required for connecting each new tool joint. Seals 210 are located at the top and bottom of the channel 208, and O-rings disposed in grooves 212 about the periphery of bypass sleeve 206 for sealing against the bore wall of float sub 204.

Figure 8:
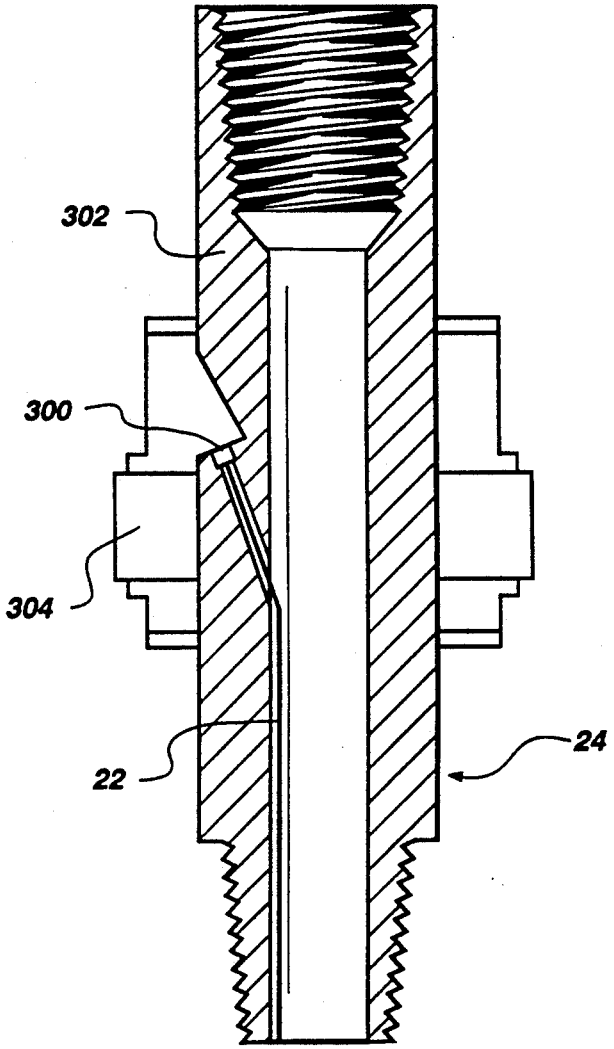
FIG. 8 is a schematic of a slip ring sub assembly for use in the present invention.

Slip ring sub assembly 24, depicted schematically in FIG. 8, fits above the kelly and includes a pack-off 300 in slip ring sub 302 which enables upper wireline 22 extending from the inside of the kelly below slip ring subassembly 24 to electrically contact the slip ring in a pressure-tight manner, the slip ring rotating with the slip ring sub 302, kelly and the drillstring (See FIG. 1). The outer stationary sub 304 of the assembly 24 contacts the rotating slip ring via collector brushes (not shown), information thus being transferred to processing unit 28 via surface cable 26. Slip ring subs and wireline pack-offs being known in the art, no further description thereof will given herein.

In certain drilling conditions, such as when continual jarring of the drillstring is required, cartridges cannot be used due to cable stretch and/or resonance, and so an alternative approach must be contemplated. Similarly, the operator may not tolerate the continual presence of cable in the drillstring above the clamp-off assembly. Therefore, it is also contemplated that the present invention may be used with a wet connect device, wherein the lower half of the wet connect is secured to the clamp-off assembly. When a survey is desired, the drillstring pulled to a point of suitable inclination, and the upper half of the wet connect run into the drillstring down to the mating wet connect at the clamp-off assembly, at which point the string is lowered to bottom, and a survey taken. After the survey, the upper portion of the wet connect is pulled. Of course, drilling may proceed with the engaged wet connect if desired or required by the operator.

A novel and unobvious apparatus and method has thus been disclosed in terms of a preferred embodiment. However, additions, deletions and modifications to the invention as disclosed will be readily appreciated by one skilled in the art, and such may be made without departing from the scope of the claimed invention.

What is claimed is:

1. An apparatus for the transmission of information between downhole and surface locations, comprising:

a first wireline extending upwardly from a location proximate the lower end of a rotatable drillstring in a borehole to a location intermediate said lower end and said surface location;

clamp-off means for mechanically securing the upper end of said first wireline at said intermediate location, for electrically connecting said upper end of said first wireline to the lower end of a cable means extending upwardly toward said surface location from said clamp-off means, and for mechanically securing said cable means lower end at said intermediate location; and packoff assembly means for maintaining a pressure-tight electrical connection at said surface location between the upper end of said cable means within said drillstring during rotation thereof and a non-rotating surface cable exterior to said drillstring.

2. The apparatus of claim 1, wherein said cable means includes:

at least one cable cartridge disposed within said drillstring including a cartridge head and a cable spool secured to and extending downwardly from said cable head, and a length of cable wound on said cable spool and having the upper end thereof mechanically secured to said cartridge head and the lower end thereof mechanically secured to said clamp-off means and electrically connected to said upper end of said first wireline; and a second wireline removably mechanically securable at its lower end to said cartridge head of said at least one cable cartridge and removably electrically connectable to said upper end of said cable, the upper end of said second wireline extending to said packoff assembly means.

3. The apparatus of claim 2, wherein said at least one cable cartridge comprises a plurality of cable cartridges longitudinally spaced in said drillstring;

the lower end of the cable length associated with the lowermost of said cable cartridges being mechanically secured to said clamp-off means and electrically connected to said first wireline thereat;

the upper end of the cable length associated with the uppermost of said cable cartridges being removably mechanically securable and electrically connectable to the lower end of said second wireline; and the lower end of the cable length associated with all but the lowermost of said cable cartridges being mechanically secured to the cartridge head and electrically connected to the upper-end of the cable length associated with the next lower cable cartridge in the drillstring.

4. The apparatus of claim 2, wherein said at least one cable cartridge has associated therewith a landing assembly removably securable to said cartridge head, said landing assembly including a housing having a plurality of pivotally mounted, spring-biased, downwardly and radially outwardly extending legs for supporting said at least one cable cartridge in the bore back of a pipe joint in said drillstring while permitting upward movement of said at least one cable cartridge in said drillstring.

5. The apparatus of claim 4, wherein said landing assembly includes a fishing head at the top thereof suitable for engagement by an overshot.

6. The apparatus of claim 2, wherein said at least one cable cartridge includes a neck portion and has associated therewith a hold down ring adapted to engage said neck portion, having a lateral dimension greater than the bore of said drillstring and sized to fit between the bore back of a pipe joint of said drillstring and the pin end of the next uppermost pipe joint in said drillstring to restrain said cable cartridge against both upward and downward movement in said drillstring.

7. The apparatus of claim 1, wherein said packoff assembly means includes a slip ring assembly for permitting said rotation of said drillstring while maintaining said pressure-tight electrical connection.

8. The apparatus of claim 1, wherein the lower end of said first wireline is mechanically secured and electrically connected to an instrumentation probe assembly for measuring downhole parameters.

9. The apparatus of claim 8, wherein said instrumentation probe assembly is removably mechanically latchable to said drillstring proximate said lower end thereof.

10. The apparatus of claim 9, wherein the lower end of said instrumentation probe assembly includes a stinger, and the lower end of said drillstring includes latch down means for receiving said stinger and mechanically engaging said stinger against a predetermined level of upwardly applied force.

11. The apparatus of claim 10, wherein said stinger and said latch down assembly means include cooperating means for rotationally aligning said instrumentation probe with respect to said drillstring.

12. The apparatus of claim 9, wherein said lower end of said drillstring above said latch down means includes resilient, radially inwardly extending centralizing means for engaging the exterior of said instrumentation probe assembly.

13. The apparatus of claim 1, wherein said clamp-off means has associated therewith the lower portion of a wet connect, and said cable means has secured to the lowermost end thereof the upper portion of a wet connect for providing a releasable mechanical and electrical connection between said first wireline and said cable means.

14. A method for facilitating the transmission of information between downhole and surface locations during a drilling operation, comprising:

providing a drillstring having a steerable bottomhole assembly at the lower end thereof and latch down means above said steerable bottomhole assembly;

running an instrumentation probe assembly into said drillstring on a first wireline and engaging said probe assembly with said latch down means;

mechanically securing the upper end of said first wireline to clamp-off means at the top of said drillstring and electrically connecting said upper end of said first wireline to the lower end of a cable length wound on a cable cartridge;

pulling said cable cartridge upwardly into the next pipe joint to be connected to the top of the drillstring while paying out cable therefrom;

making the pipe joint connection to the top of said drillstring;

pulling the cable cartridge to the top of the drillstring;

connecting the upper end of said cable length to a second wireline extending from a packoff assembly above a kelly above said drillstring;

securing said cable cartridge against upward and downward movement with respect to said drillstring by making up the top of said drillstring to said kelly;

commencing said drilling operation; and transmitting information between said instrumentation probe and said packoff assembly during said drilling operation.

15. The method of claim 14, further including the steps of:

drilling down said drillstring a predetermined distance;

providing another pipe joint for connection to the top of said drillstring;

breaking the connection between said kelly and said drillstring;

breaking the connection between said second wireline and said cable;

connecting said another pipe joint to the top of said drillstring;

pulling said cable cartridge through said another pipe joint to the top thereof while paying out said cable therefrom;

reconnecting said second wireline and said cable;

making up said kelly to said drillstring;

securing said cartridge against said upward and downward movement;

drilling down said another pipe joint.

16. The method of claim 15, and further including the steps of:

pulling up said drillstring to the connection point of said kelly and said another pipe joint;

breaking the connection at said connection point;

breaking the connection between said second wireline and said cable;

reconnecting a further pipe joint to the top of said drillstring;

lowering said drillstring to bottom;

pulling said cable cartridge up through said drillstring to the top of said another pipe joint while paying out said cable therefrom;

connecting said second wireline to said cable at said cartridge;

making up said kelly to said drillstring and securing said cable cartridge against upward and downward movement; and drilling down said further pipe joint.

17. The method of claim 14, further including the step of rotating said drillstring during said drilling operation while transmitting said information through said packoff assembly.

18. The method of claim 14, further including the step of providing at least one float sub in said drillstring between said cable cartridge and said clamp-off means, and extending said cable past said float sub in a pressure-tight manner.

19. An apparatus for the transmission of information between downhole and surface locations, comprising:

a first wireline extending upwardly within a rotatable drillstring from an instrumentation probe assembly for measuring downhole parameters, said instrumentation probe assembly being located proximate the lower end of said drillstring, the lower end of said first wireline being electrically connected to said instrumentation probe assembly;

suspension means for mechanically securing the upper end of said first wireline at a location within said drillstring intermediate said instrumentation probe assembly and said surface location;

cable means extending upwardly from said clamp-off means toward said surface location, the lower end of said cable means being electrically connected to said upper end of said first wireline; and packoff assembly means for making a pressure-tight electrical connection at said surface location between the upper end of said cable means within said drillstring during rotation thereof and a non-rotating conductor at said surface location.

20. The apparatus of claim 19, wherein said packoff assembly means includes a slip ring assembly for permitting said rotation of said drillstring while maintaining said pressure-tight electrical connection.

21. A method for facilitating the transmission of information between downhole and surface locations during a drilling operation, comprising:

providing a rotatable drillstring having an instrumentation probe assembly at the lower end thereof;

disposing a first wireline within said drillstring;

mechanically securing the upper end of said first wireline proximate the upper end of said drillstring;

mechanically and electrically connecting the lower end of said first wireline to said instrumentation probe assembly;

disposing conductor means between said secured upper end of said first wireline and packoff means above a kelly at the top of said drillstring, said packoff means having a surface cable extending from the exterior thereof to said surface location;

rotating said drillstring during at least a portion of said drilling operation; and transmitting information between said instrumentation probe assembly and said surface location through said packoff means while said drillstring is rotating.

22. The method of claim 21, further including the steps of:

locating said conductor means within a pipe joint; and interposing and connecting said pipe joint between the top of said drillstring and said kelly.

23. The method of claim 22, further including the steps of:

drilling down said drillstring a predetermined distance;

breaking the connection between said kelly and said drillstring;

locating said conductor means within another pipe joint;

connecting said another pipe joint to the top of said drillstring;

making up said kelly to the top of said another pipe joint; and drilling down said another pipe joint.

24. An apparatus for the transmission of information between downhole and surface locations, comprising:

a first wireline extending upwardly from a location proximate the lower end of a drillstring in a borehole to a location intermediate said lower end and said surface location;

cable means including at least one cable cartridge disposed within said drillstring including a cartridge head and a cable spool secured to and extending downwardly from said cable head, and a length of cable wound on said cable spool and having the upper end thereof mechanically secured to said cartridge head and the lower end thereof mechanically secured to said clamp-off means and electrically connected to said upper end of said first wireline; and a second wireline removably mechanically securable at its lower end to said cartridge head of said at least one cable cartridge and removably electrically connectable to said upper end of said cable, the upper end of said second wireline extending to said packoff assembly means;

clamp-off means for mechanically securing the upper end of said first wireline to said intermediate location, for electrically connecting said upper end of said first wireline to the lower end of said cable means extending upwardly toward said surface location from said clamp-off means, and for mechanically securing said cable means lower end at said intermediate location; and packoff assembly means for making a pressure-tight electrical connection at said surface location between the upper end of said cable means within said drillstring and the exterior of said drillstring.

25. The apparatus of claim 24, wherein said at least one cable cartridge comprises a plurality of cable cartridges longitudinally spaced in said drillstring;

the lower end of the cable length associated with the lowermost of said cable cartridges being mechanically secured to said clamp-off means and electrically connected to said first wireline thereat;

the upper end of the cable length associated with the uppermost of said cable cartridges being removably mechanically securable and electrically connectable to the lower end of said second wireline; and the lower end of the cable length associated with all but the lowermost of said cable cartridges being mechanically secured to the cartridge head and electrically connected to the upper end of the cable length associated with the next lower cable cartridge in the drillstring.

26. The apparatus of claim 24, wherein said at least one cable cartridge has associated therewith a landing assembly removably securable to said cartridge head, said landing assembly including a housing having a plurality of pivotally mounted, spring-biased, downwardly and radially outwardly extending legs for supporting said at least one cable cartridge in the bore back of a pipe joint in said drillstring while permitting upward movement of said at least one cable cartridge in said drillstring.

27. The apparatus of claim 26, wherein said landing assembly includes a fishing head at the top thereof suitable for engagement by an overshot.

28. The apparatus of claim 24, wherein said at least one cable cartridge includes a neck portion and has associated therewith a hold down ring adapted to engage said neck portion, having a lateral dimension greater than the bore of said drillstring and sized to fit between the bore back of a pipe joint of said drillstring and the pin end of the next uppermost pipe joint in said drillstring to restrain said cable cartridge against both upward and downward movement in said drillstring.

29. The apparatus of claim 24, wherein said packoff assembly means includes a slip ring assembly for permitting said rotation of said drillstring while maintaining said pressure-tight electrical connection.

30. The apparatus of claim 24, wherein the lower end of said first wireline is mechanically secured and electrically connected to an instrumentation probe assembly for measuring downhole parameters.

31. The apparatus of claim 30, wherein said instrumentation probe assembly is removably mechanically latchable to said drillstring proximate said lower end thereof.

32. The apparatus of claim 31, wherein the lower end of said instrumentation probe assembly includes a stinger, and the lower end of said drillstring includes latch down means for receiving said stinger and mechanically engaging said stinger against a predetermined level of upwardly applied force.

33. The apparatus of claim 32, wherein said stinger and said latch down assembly means include cooperating means for rotationally aligning said instrumentation probe with respect to said drillstring.

34. The apparatus of claim 31, wherein said lower end of said drillstring above said latch down means includes resilient, radially inwardly extending centralizing means for engaging the exterior of said instrumentation probe assembly.

35. The apparatus of claim 24, wherein said clamp-off means has associated therewith the lower portion of a wet connect, and said cable means has secured to the lowermost end thereof the upper portion of a wet connect for providing a releasable mechanical and electrical connection between said first wireline and said cable means.

* * * * *

UNITED STATES PATENT AND TRADEMARK OFFICE

CERTIFICATE OF CORRECTION

PATENT NO. : 5,294,923

DATED : March 15, 1994

INVENTOR(S) : Juergens et al.

It is certified that error appears in the above-identified patent and that said Letters Patent is hereby corrected as shown below:

In Column 4, line 27, change "though" to --through--;

In Column 5, line 6, change "also 42" to --42 also--;

In Column 5, line 13, change "spacers" to --spacer--;

In Column 7, line 51, change "86" to --34--;

In Column 8, line 7, change "cable head" to --cartridge head--;

In Column 8, line 46, after "will" insert --be--;

In Column 8, line 57, after "drillstring" insert --is--;

In Column 13, line 12, after "wireline" change "to" to --at--;

In the drawings, Sheet 1, FIG. 1, the reference numeral 10 should be added at the center of the sheet and underlined.

Signed and Sealed this

Sixth Day of September, 1994

*Attest:*

Bruce Lehman

BRUCE LEHMAN

*Attesting Officer*

*Commissioner of Patents and Trademarks*